US006082439A

United States Patent [19]

Kato et al.

[11] Patent Number: 6,082,439

[45] Date of Patent: Jul. 4, 2000

[54] HEAT EXCHANGER ASSEMBLED WITHOUT BRAZING IN WHICH ADHESIVE IS USED TO SEAL A COMBINED PORTION AND A CORE PLATE

[75] Inventors: Seiichi Kato, Toyoake; Hisashi Nakashima, Kariya; Sumio Susa, Anjo, all of Japan

[73] Assignee: Denso Corporation, Kariya, Japan

[21] Appl. No.: 08/978,461

[22] Filed: Nov. 26, 1997

[30] Foreign Application Priority Data

Nov. 29, 1996 [JP] Japan ..... 8-319939

[51] Int. Cl.[7] ..... F28F 7/00; F28F 9/16

[52] U.S. Cl. ..... 165/79; 165/173; 165/178; 165/906

[58] Field of Search ..... 165/173, 175, 165/178, 906, 79

[56] References Cited

U.S. PATENT DOCUMENTS

| | | | |
|---|---|---|---|
| 2,184,658 | 12/1939 | Young . | |
| 3,625,170 | 12/1971 | Josok . | |
| 3,633,660 | 1/1972 | Young . | |
| 4,234,041 | 11/1980 | Melnyk | 165/173 |
| 4,316,503 | 2/1982 | Kurachi et al. . | |
| 4,546,822 | 10/1985 | Tamura | 165/149 |
| 4,582,127 | 4/1986 | Moranne | 165/173 X |
| 4,881,594 | 11/1989 | Beamer et al. | 165/173 |
| 4,971,145 | 11/1990 | Lyon | 165/173 |
| 5,492,172 | 2/1996 | Laveran et al. | 165/173 |
| 5,676,200 | 10/1997 | Laveran | 165/173 X |

FOREIGN PATENT DOCUMENTS

| | | | |
|---|---|---|---|
| 0 000 189 | 1/1979 | European Pat. Off. . | |
| 2034351 | 12/1970 | France . | |
| 2009 122 | 9/1970 | Germany . | |
| 107896 | 8/1980 | Japan | 165/173 |
| 99498 | 4/1988 | Japan | 165/79 |
| 731431 | 6/1955 | United Kingdom | 165/79 |
| 1485287 | 9/1977 | United Kingdom . | |

*Primary Examiner*—Leonard Leo
*Attorney, Agent, or Firm*—Harness, Dickey & Pierce, PLC

[57] ABSTRACT

In a mechanically assembled type heat exchanger, in which an end portion of an oval tube is inserted into a barring hole of a core plate and expanded to be press fit to the core plate. Then adhesive is potted on the core plate for sealing the press fit portion in the end of the tube. A reinforcing member is formed around the barring hole for increasing the rigidity of the core plate so as to improve the durability of sealing.

10 Claims, 17 Drawing Sheets

HEAT EXCHANGER ASSEMBLED WITHOUT BRAZING IN WHICH ADHESIVE IS USED TO SEAL A COMBINED PORTION AND A CORE PLATE

CROSS-REFERENCE TO RELATED APPLICATION

This application is based on and claims priority of Japanese Patent Application No. Hei. 8-319939 filed on Nov. 29, 1996, the contents of which are incorporated herein by reference.

BACKGROUND OF THE INVENTION

1. Field of the Invention

The present invention relates to a heat exchanger assembled without brazing, and to a mechanically assembling method in which adhesive is used to seal a combined portion between a tube and a core plate, which is effectively applied to a radiator for cooling car engine coolant.

2. Description of Related Art

Heat exchangers in which adhesive is used to seal the combined portion are known. According to these conventional structures, a supporting structure at the combined portion is such as shown in FIGS. 17A–17C, for example. That is, after both ends of a cylindrical tube 14 being inserted into a circular barring hole 16*a* of a core plate 16, the tube 14 is expanded so that outer peripheral surface of both ends of the tube 14 (the combined portion) are press fit with inner peripheral surface of the barring hole 16*a* of the core plate 16, thus, the tube 14 and the core plate 16 are integrated.

Next, adhesive 24 is potted at an air flowing side face (right side face of FIG. 17B) of the core plate 16 to seal the press fit combined portion between the tube 14 and the core plate 16. Thus, water leak from this press fit combined portion is prevented.

However, according to the result of study of tests with respect to a sample of above-mentioned mechanically assembled type heat exchanger in which the combined portion is sealed by potting the adhesive 24, it was found that a difficulty of sealing at the combined portion sealed by adhesive is caused by the following reason.

When the heat exchanger is under the working condition, a pressure inside the heat exchanger rises, thereby, the core plate 16 is deformed as shown in FIG. 18B. Two-dot chain line A in FIG. 18B shows the core plate 16 which is not effected by the inside pressure, and solid line B shows the core plate 16 which is deformed by the inside pressure. Since the inner peripheral surface of a barring hole 16*a* of the core plate 16 is press fit to both ends of the tube 14, in case that pressure is increased inside a tank chamber constructed by the core plate 16 and a resinous upper tank 12 (or lower tank 13), as shown in FIG. 18A, out of the core plate 16, a portion of the core plate 16 in a groove 16*b* side which is connected to the tank 12 (tank 13) by caulking is deformed toward the tank 12 (tank 13), for pressure receiving area in the tank 12 (tank 13) side is large.

Due to the above-mentioned deformation of the core plate 16, adhesive 24 potted on the air flowing side surface of the core plate 16 is effected by stretching stress. Under this stretching condition, since the intermolecular distance of the adhesive becomes large, intruding speed of any other molecule consisting of the fluid inside the tank (in case of radiator, engine coolant including anti-freeze ingredient and anti-corrosive ingredient, and so on) into the adhesive 24 increases.

Furthermore, when molar volume of the above molecular becomes decreased by the rise in inside pressure, the intruding speed of the molecule into the adhesive becomes more increased.

Thus, deterioration of the adhesive 24 itself proceeds, and cohesive destruction of the adhesive 24 and exfoliation of the bonded surface arise. As a result, sealing difficulty at the combined portion (being denoted as "a" in FIG. 18B) and the leak of the fluid inside tank (water leak) arise.

Especially, recently, for reducing cost and weight, reducing the thickness (t) of an aluminum alloy core plate 16 (for example, 0.8–1.2 mm) and replacing a cylindrically shaped tube with an oval tube (the ratio of long diameter to short diameter: about 2–5) are greatly required. Accordingly, rigidity of the core plate 16 is reduced and the deformation is likely to be increased, so, the sealing difficulty at the combined portion becomes remarkable.

SUMMARY OF THE INVENTION

An object of the present invention is to improve durability of sealing in a heat exchanger in which a combined portion is sealed by potting adhesive.

The present invention achieves the above object by adopting a reinforcing structure to reinforce the tube combined portion at the core plate.

Namely, for achieving the above object, according to the present invention, in a heat exchanger in which an end portion of a tube is inserted into a hole formed on a core plate, and the tube is press fit to the core plate by expanding the inside diameter of the tube, after that, adhesive is potted on the core plate for sealing the press fit portion of the end portion of the tube, and an concave and convex formed reinforcing member located at least around the hole of the core plate is provided. By this reinforcing member, the rigidity of the core plate is increased.

Thereby, when an inside pressure of the heat exchanger affects on the core plate, a deformation of the core plate, especially, a deformation around the hole to which the tube is press fit can be reduced efficiently. So, cohesive destruction of the adhesive itself and exfoliation of the bonded surface due to the deformation of the core plate caused by the inside pressure are reduced.

Accordingly, a good sealing function at the press fitted portion of the tube end is guaranteed in the long period by the adhesive potted on this press fit portion.

Alternatively, for achieving the same object, according to the present invention, in a heat exchanger in which an end portion of a tube is inserted into a hole formed on a core plate, and the tube is press-fit to the core plate by expanding the inside diameter thereof. After that, adhesive is potted on the core plate for sealing the press-fit portion of the end portion of the tube and, finally, a reinforcing member which is formed of an independent plate material of the core plate is connected to at least around said hole integrally. By this reinforcing member, the rigidity of the core plate is increased.

Thereby, the rigidity of the core plate is increased due to the reinforcing member formed of an independent plate material to the core plate, so that, a good sealing function at the press fit portion of the tube end can be guaranteed in the long period by the adhesive potted on this press fit portion.

BRIEF DESCRIPTION OF THE DRAWINGS

Additional objects and advantages of the present invention will be more readily apparent from the following detailed description of preferred embodiments thereof when taken together with the accompanying drawings in which:

FIG. 18B and FIG. 18C are enlarged cross sectional views of the conventional radiator.

DETAILED DESCRIPTION OF PREFERRED EMBODIMENTS

Figure 1:
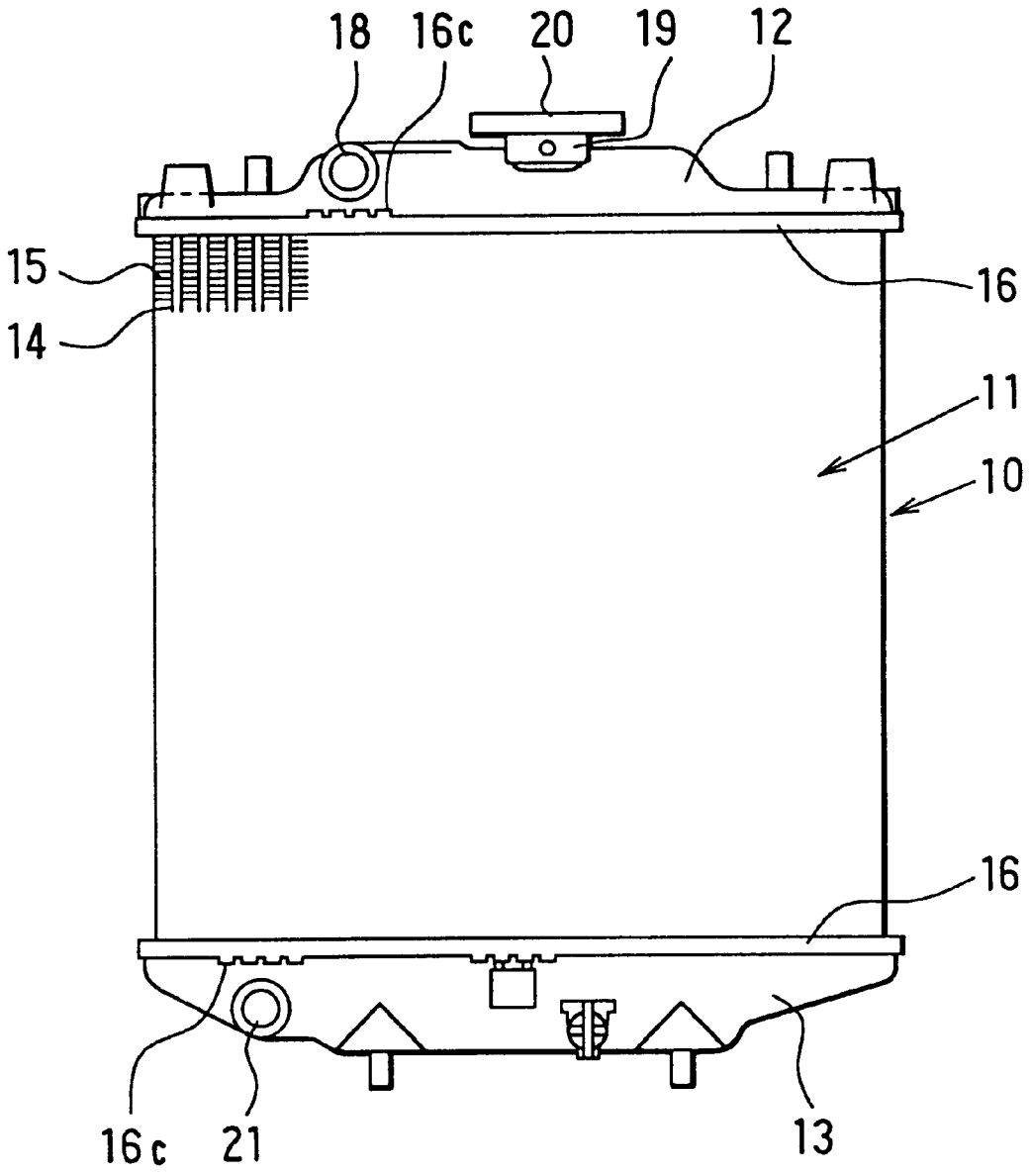
FIG. 1 is a front view of a heat exchanger according the first embodiment of the present invention.

Referring to the drawings, preferred embodiments of the present invention will be described.

(First Embodiment)

A heat exchanger used for a car radiator is constructed, as shown in FIG. 1, by a core portion 11 to carry out heat exchange between an engine coolant and a cooling air (outside air), an upper tank 12, and a lower tank 13, in general.

Figure 2:
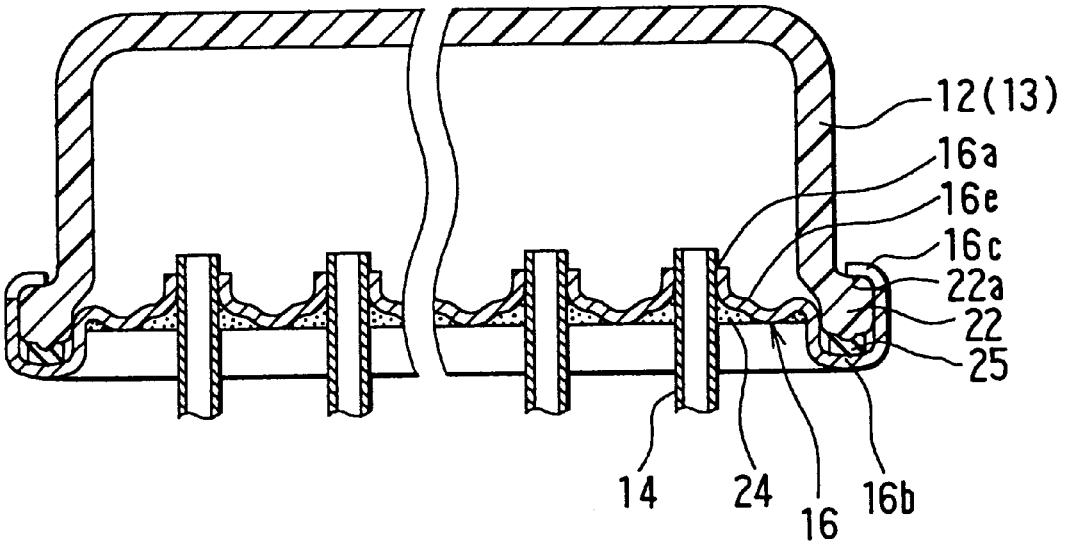
FIG. 2 is a front cross sectional view of a tank of the heat exchanger in FIG. 1.

The core portion 11 is constructed by a plurality of tubes 14, plate fins 15, an upper core plate 16, and a lower core plate 16. Theses parts 14, 15, 16 of the core portion 11 are made of a metal which has a high heat conductivity and a high corrosion resistance, such as an aluminum alloy. Further, as shown in FIG. 2, the tube 14 is formed into oval shape in cross section, and its combined portions (both ends portion) are press fit to each barring hole 16*a* formed into cross sectional oval shape of the upper and lower tank 16. In this, the "barring hole" 16*a* is defined as a shape provided with a protrusion portion protruding into inside the tank (water side) from edge of a cross sectional oval shape hole. Both end portions of the tube 14 are opened in each chamber inside the upper tank 12 and the lower tank 13.

It is to be noted that the oval shape in this specification includes an ellipse shape formed by a curve shape consisting of first circular arc whose radius of curvature is large and second circular arc whose radius of curvature is small, or an elongated oval shape formed by a circular arc and a liner line, etc. The example disclosed in some Figures is the ellipse shape.

The oval tubes 14 are arranged in such a manner that a major axis direction is parallel to a cooling air flowing direction C (refer to FIG. 4B), and many parallel tubes 14 are arranged in the lateral direction in FIG. 1 in order that a predetermined distance between adjacent tubes is provided. Setting a ratio of the major axis direction size L1 the oval tube 14 L1 to the minor axis direction size L2 (L1/L2) is about 2–5 is preferable for reducing a pressure resistance in the air side, for enhancing the heat exchange efficiency, and for simplifying a tube expanding operation.

While, many plate fins 15 are stacked in a predetermined pitch in a tube axis direction in FIG. 1. This pitch between adjacent plate fins 15 are set by protruded pins (not illustrated) integrated with the plate fin 15, and supported. Also, in the plate fin 15, oval shape barring holes (not illustrated) corresponding to the oval shape tube 14 are formed, and the oval shape tubes 14 are inserted into the oval shape barring holes, thus, the plate fin 15 is press fit to the oval shaped tube 14 in the barring hole. Further, in the plate fin 15, a plurality of louvers (not illustrated) are formed diagonally in the well known manner.

Figure 3:
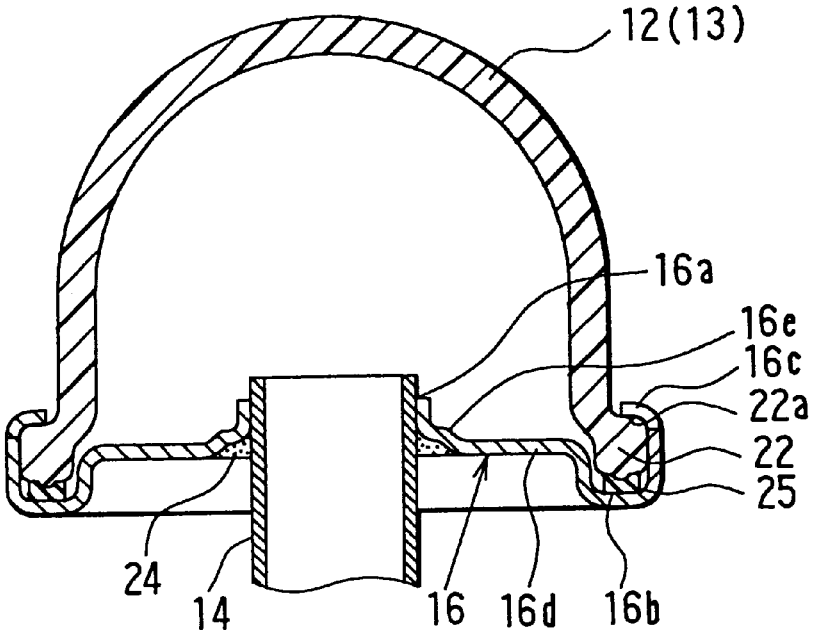
FIG. 3 is a side cross sectional view transverse to FIG. 2.

Further, an outer shape of the upper (lower) core plate 16 is in an elongated rectangular shape, and this core plate 16 is provided with the above-described cross sectional oval shape barring holes 16*a* at the center region, and as shown in FIG. 2 and FIG. 3, a groove 16*b* into which a sealing packing 25 is installed is formed at an outer periphery of the core plate 16. The packing 25 is made of elastic material such as a rubber. The groove 16*b* is formed along outer periphery of the core plate 16, and it makes a closed circuit. At a lid portion of the periphery of the core plate 16, a plurality of clips 16*c* for caulking are formed in all round.

The upper tank 12 and the lower tank 13 are made of resin having a high heat resistance and strength etc. and formed into box shape having a opening surface 22. An inlet pipe 18 into which a coolant from the car engine is introduced and a coolant feeding port 19 etc. are integrated with the upper tank 12, and a well known pressurizing cap 20 is attached to the coolant feeding port 19 removably. Also, an outlet pipe 21 from which the coolant flows out is integrated with the lower tank 13.

Further, after setting the opening surface 22 of the upper and lower tanks 12 and 13 on the sealing packing 25, by press forming the clip 16*c* of the core plate 16 onto a shoulder portion 22*a* of the opening surface 22, the packing 25 is subjected to be compressed elastically.

Figure 4A:
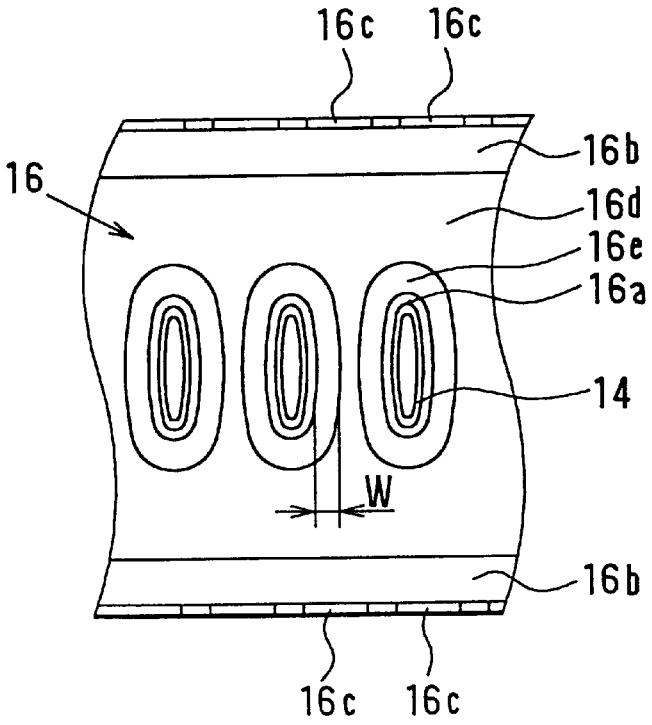
FIG. 4A is an enlarged plan view of a principal part according to the first embodiment of the present invention.
Figure 4B:
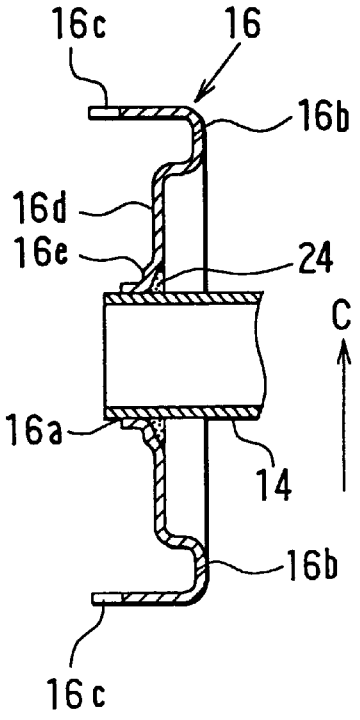
FIG. 4B and FIG. 4C are cross sectional views of shown FIG. 4A.
Figure 4C:
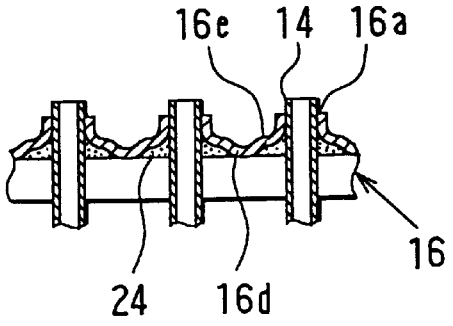

Next, the supporting structure of the core plate 16 in the first embodiment will be explained in more detail. As shown in FIGS. 4A–4C, the center region of the main flat portion 16*d*, a step portion 16*e* is integrally protruded from a surface of the main flat portion 16*d* toward a protruding direction of the barring hole 16*a* (tank inside direction) in the whole outer peripheral side of the protrusion portion of this barring hole 16*a*, at the same time of forming the above-mentioned cross sectional oval shape barring hole 16*a* is formed. This step portion 16*e* is formed into ellipse shape having a predetermined width W along the outer peripheral surface of the barring hole 16*a*.

This step portion 16*e* increases a rigidity of the core plate 16 by increasing the section modulus of the core plate 16 in the barring hole 16*a* region and by increasing the geometrical moment of inertia.

It is to be noted that, the thickness of the core plate 16 according to the present embodiment is 0.8–1.2 mm, and the thickness of the tube 14 is 0.25–0.50 mm. Also, the width W of the step portion 16*e* shown in FIG. 4A is about 3–5 mm, as a design example.

Next, an assembling method of the heat exchanger of the present embodiment will be explained. At first, the predetermined number of the plate fins 15 are stacked in a predetermined pitch in the upper and lower direction in FIG. 1, and the oval tubes 14 are inserted into each barring hole (not illustrated) of the plate fins 15.

Next, by inserting an expanding instrument (not illustrated) into the oval tube 14 and expanding inside diameter of the oval tube 14, the outer peripheral surface of the oval tubes 14 are press fit to the respective inner surface of the barring hole of the plate fins 15. Thus, the plate fins 15 are fixed to the oval tubes 14.

Both upper and lower ends of the tube 14 are inserted into the barring hole 16*a* of the upper and lower core plates 16 respectively.

By inserting the expanding instrument (not illustrated) into the both upper and lower ends of the oval tube 14, and also expanding inside diameter of the oval tube 14, both upper and lower ends of the oval tube 14 are press fit to the inner surface of the barring hole 16*a* of the core plate 16, and both upper and lower ends of the oval tube 14 are fixed to the core plate 16.

Out of the main flat portion 16*d* of the core plate 16, around the tube combined portion of the air flowing side surface (the right side surface in FIG. 4B) the adhesive 24 is potted. Here, as the adhesive 24, a rubber type adhesive, more specifically a silicon rubber type adhesive, having high resistance for heat and chemical such as anti-freezing ingredient and anti-corrosive ingredient etc., and so on, is preferable. Further, since the air flowing side surface of the step portion 16*e* is formed into cup shape which stores the adhesive 24 around the oval tube 14, the adhesive is firmly stored around the oval tube 14.

The packing 25 is installed into the groove 16*b* of the upper and lower core plate 16.

The tank 12 and 13 are assembled to the upper and lower core plates 16 such that the opening surfaces 22 and 23 of the upper and lower resin tanks 12 and 13 are located on the packing 25.

Finally, the clip 16*c* of the core plate 16 is press formed to the shoulder portion 22*a* of the opening surface 22 under the condition that the opening surface of each upper and lower tanks 12 and 13 are press fixed to the sealing packing 25. Thereby, the upper and lower core plate 16 and the upper and lower tank 12 and 13 are connected integrally, and the sealing packing 25 is press fixed to the opening surface 22 and the groove 16*b* by elastically compressed deformation. By the above-described operation, the assembling of the entire heat exchanger is completed.

Next, an operation of the above-described component will be explained. The engine coolant flowing into the upper tank 12 through the inlet pipe 18 is introduced into the tube 14 through the upper end port of the oval tube 14 which is opening inside the upper tank 12. While the coolant is passing through this tube 14, the coolant carries out a heat exchange with the cooling air through the plate fin 15 and is cooled down.

The engine coolant flows into the lower tank 13 after passing through the tube 14, and it flows out from the outlet pipe 21 and returns to the engine.

Here, the radiator according to the present embodiment is assembled by mechanically assembling method without brazing as mentioned above, however, the packing 25 is compressed elastically between the upper (lower) tank 16 and the groove 16*b* and performs a sealing function, so the prevention of the water leak from the opening surface 22 of the upper and lower tank 12, 13 is firmly obtained.

While, when the car engine is working, inside an engine cooling recirculation passage, an internal pressure (for example, 88 kPa) arises by a water pump operation. Thus, the core plate 16 tends to be deformed by this internal pressure. However, in the present embodiment, the step portion 16*e* is integrally protruded from the surface of the main flat portion 16*d* toward the protruding direction of the barring hole 16*a* (tank inside direction) in the entire outer peripheral side of the protrusion portion of this barring hole 16*a* formed at the center region of the main flat portion 16*d* of the core plate 16. Since, the step portion 16*e* is formed, increasing the section modulus of the core plate 16 in the barring hole 16*a* region and increasing the geometrical moment of inertia are provided, whereby, the rigidity of the core plate 16 is increased efficiently.

Thus, if the internal pressure under the car engine working affects on the core plate 16, the prevention of the deformation of the core plate 16, especially the deformation at the barring hole 16*a* region which is press fit by the tube 14, is efficiently obtained. So, the cohesive destruction of the adhesive 24 itself and the exfoliation of the bonded surface caused by the deformation based on the internal pressure of the core plate are reduced.

Accordingly, at the press fit portion between the upper/lower core plate 16 and the upper/lower end portion of the tube 14, this adhesive 24 potted on this press fit portion can prevent the water leak in the long period.

(Second embodiment)

Figure 5A:
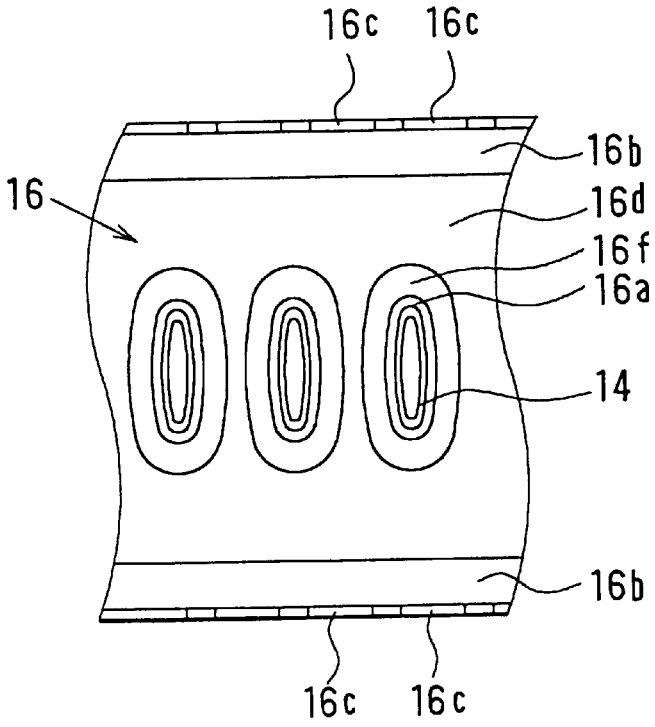
FIG. 5A is an enlarged plan view of a principal part according to the second embodiment of the present invention.
Figure 5B:
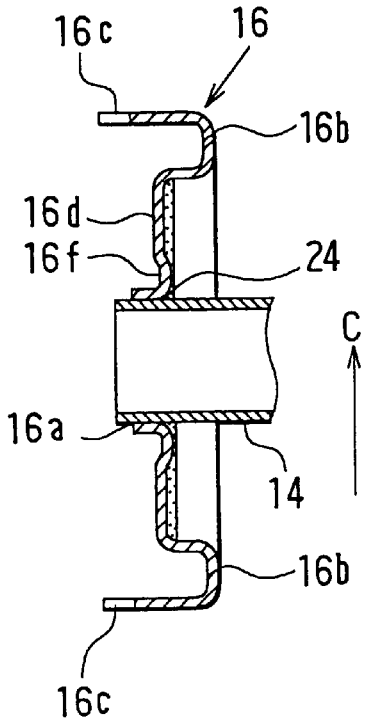
FIG. 5B and FIG. 5C are cross sectional views of shown FIG. 5A.
Figure 5C:
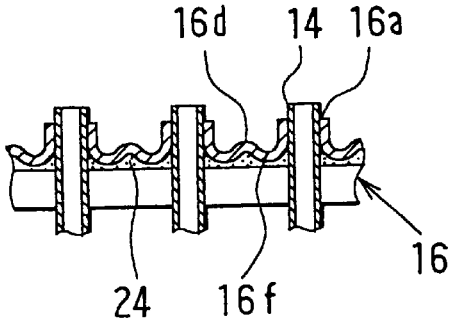

In the second embodiment shown in FIGS. 5A–5C, a step portion 16*f* is integrally protruded from the surface of the main flat portion 16*d* toward the air flowing side (outside the tank) in the entire outer peripheral side of the protrusion portion of the barring hole 16*a* formed at the center region of the main flat portion 16*d* of the core plate 16.

That is, although, the stage portion 16*e* of the first embodiment is protruded toward the protruding direction of the barring hole 16*a* (tank inside direction), the step portion 16*f* of the second embodiment is protruded toward the opposite direction.

According to the second embodiment, also, by forming the step portion 16*f*, increasing the section modulus of the core plate 16 in the barring hole 16*a* region, the rigidity of the core plate 16 is increased efficiently. So, in the similar way as in the first embodiment, the sealing ability by the adhesive 24 can be maintained in the long period.

(Third Embodiment)

Figure 6A:
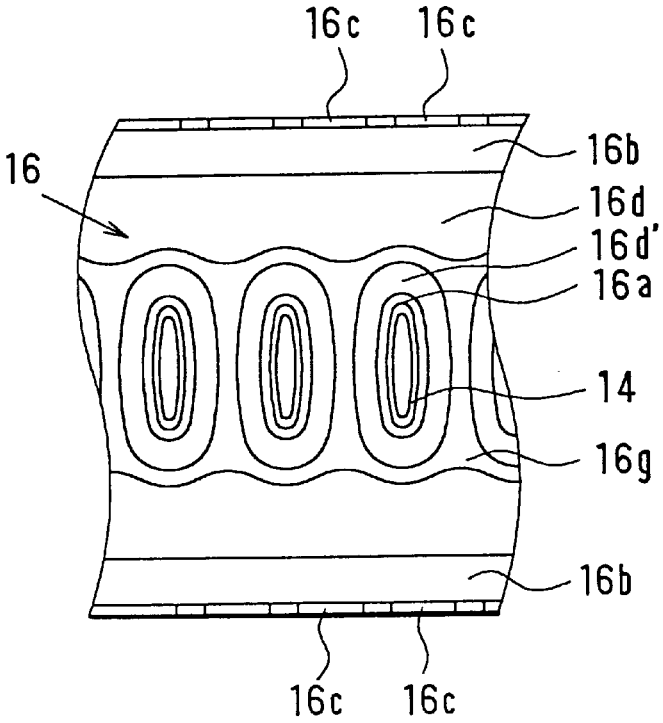
FIG. 6A is an enlarged plan view of a principal part according to the third embodiment of the present invention.
Figure 6B:
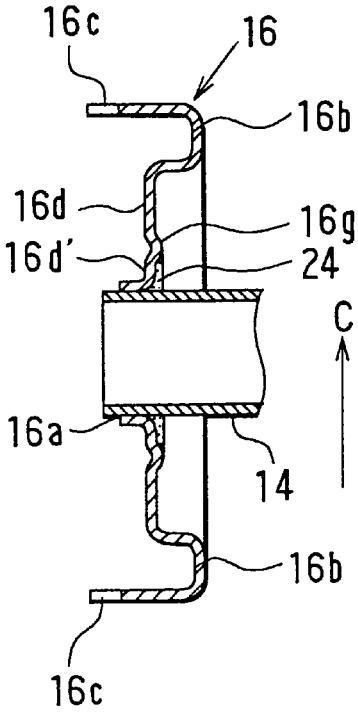
FIG. 6B and FIG. 6C are cross sectional views of shown FIG. 6A.
Figure 6C:
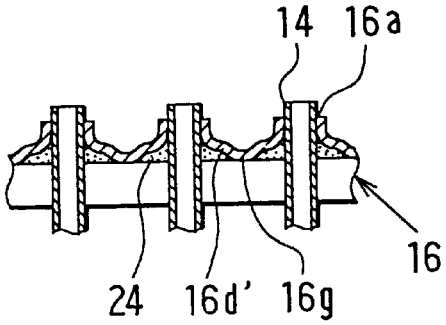

In the third embodiment shown in FIGS. 6A–6C, out of the main flat portion 16*d*, a combined portion 16*d*' of the barring hole 16*a* is located on the same plane as the main flat portion 16*d* (as shown in FIG. 6B), and between the combined portion 16*d*' and the main flat portion 16*d*, a rib 16*g* protruding toward the air flowing side of these portions 16*d*', 16*d* is formed.

According to the third embodiment, by forming the rib 16*g*, the rigidity of the core plate 16 in the main axis direction of the oval tube become much increased than that of the first embodiment.

(Fourth Embodiment)

Figure 7A:
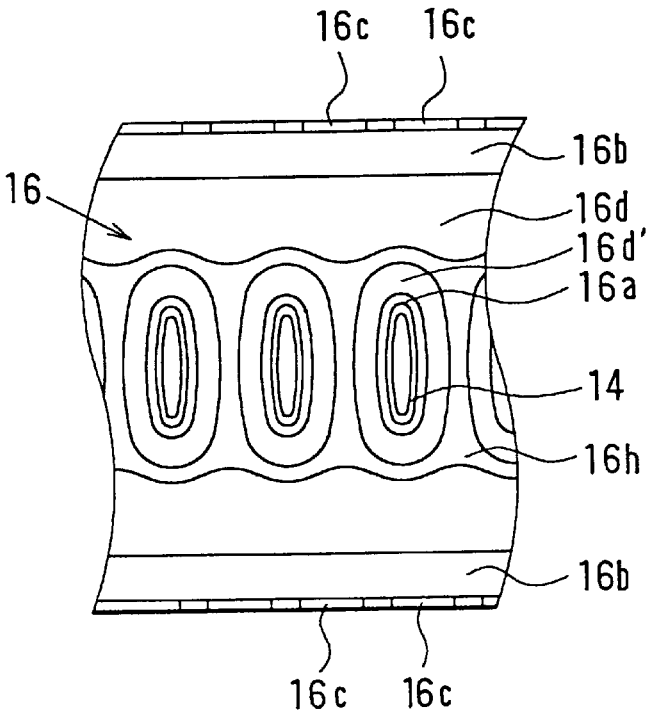
FIG. 7A is an enlarged plan view of a principal part according to the fourth embodiment of the present invention.
Figure 7B:
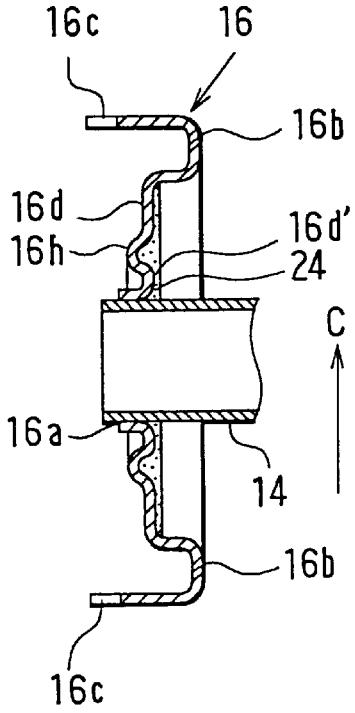
FIG. 7B and FIG. 7C are cross sectional views of shown FIG. 7A.
Figure 7C:
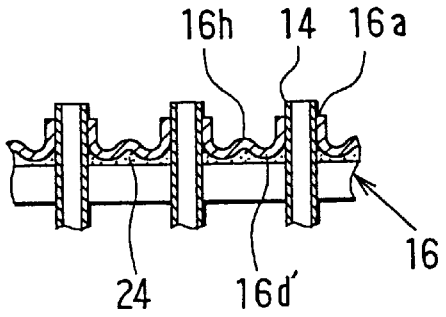

In the fourth embodiment shown in FIGS. 7A–7C, the combined portion 16*d*' of the barring hole 16*a* of the core plate 16 is located on substantially the same plane as the main flat portion 16*d*, and between the combined portion 16*d*' of the barring hole 16*a*, a rib 16*h* protruding toward the water flowing side (the barring hole 16*a* protruding direction) is formed.

According to the fourth embodiment, by forming this rib 16*h*, increasing the section modulus of the core plate 16 in the barring hole 16*a* region is obtained, the rigidity of the core plate 16 is increased efficiency.

(Fifth Embodiment)

Figure 8A:
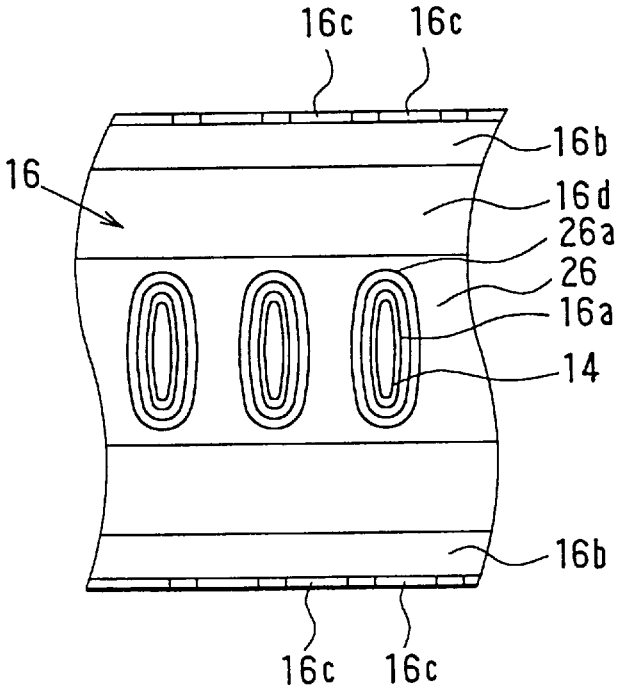
FIG. 8A is an enlarged plan view of a principal part according to the fifth embodiment of the present invention.
Figure 8B:
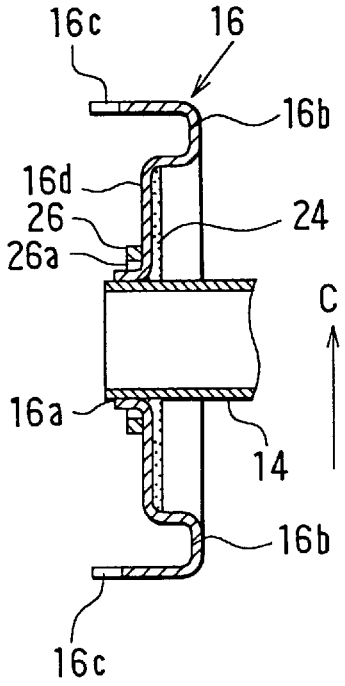
FIG. 8B and FIG. 8C are cross sectional views of shown FIG. 8A.
Figure 8C:
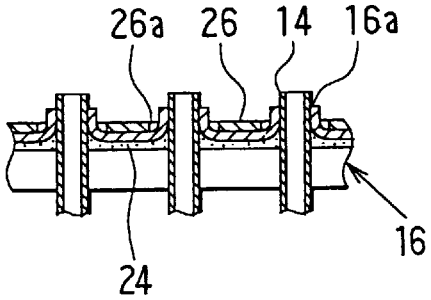

In the fifth embodiment shown in FIGS. 8A–8C, a reinforcing member 26 partially formed with the core plate 16 is combined. This reinforcing member 26 is formed by an aluminum rectangular plate, and a perforation 26*a* formed in the center thereof is attached to an outer periphery side of the protrusion of the barring hole 16*a* of the core plate 16. This reinforcing member 26 and the core plate 16 are fixed to each other by expanding the protrusion of the barring hole 16*a*, which is done by expanding inside diameter of the both ends of the oval tube 14.

According to the fifth embodiment, by attaching the reinforcing member 26 as an independent part to the outer peripheral side of the barring hole 16*a* of the core plate 16, the rigidity of the core plate 16 in the barring hole 16*a* region is increased efficiently.

In the fifth embodiment, it is for granted that the other connecting method of brazing or spot welding etc. can be used as a means for attaching the reinforcing member 26 to the core plate 16.

(Sixth Embodiment)

Figure 9A:
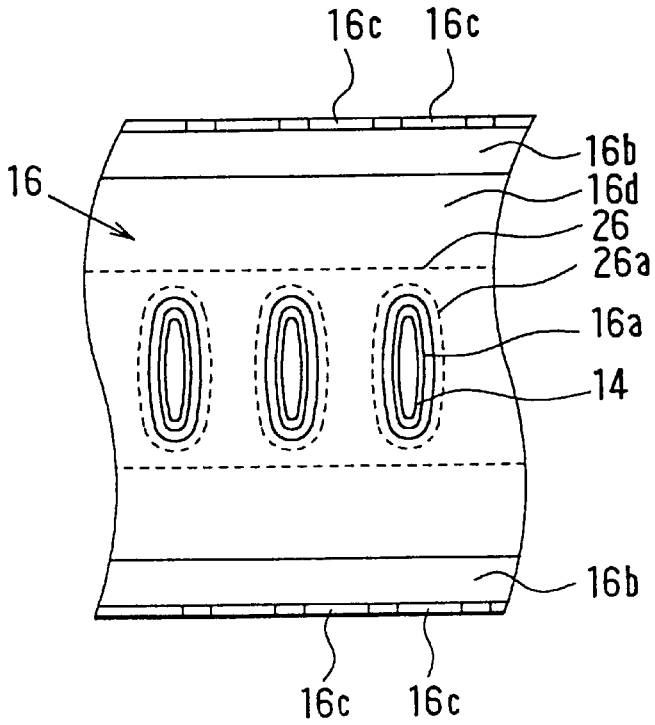
FIG. 9A is an enlarged plan view of a principal part according to the sixth embodiment of the present invention.
Figure 9B:
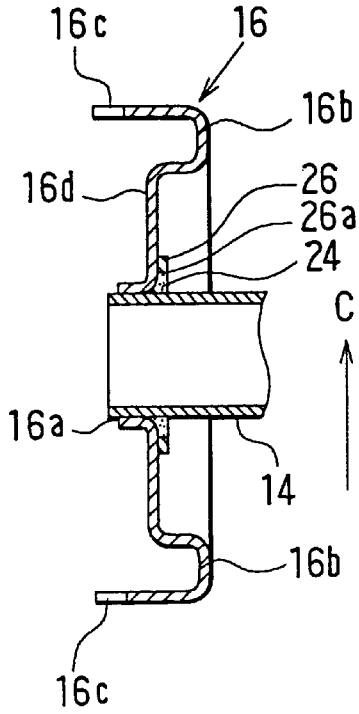
FIG. 9B and FIG. 9C are cross sectional views of shown FIG. 9A.
Figure 9C:
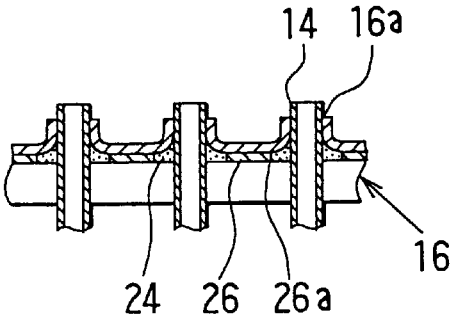

In the sixth embodiment shown in FIGS. 9A–9C, the reinforcing member 26 as an independent part in the fifth embodiment is arranged on the air flowing side face of the main flat portion 16*d* of the core plate 16 for increasing the rigidity of the core plate 16. Fixing between the reinforcing member 26 as an independent part and the core plate 16 can be done by the connecting method such as brazing or spot welding etc.

(Seventh Embodiment)

Figure 10A:
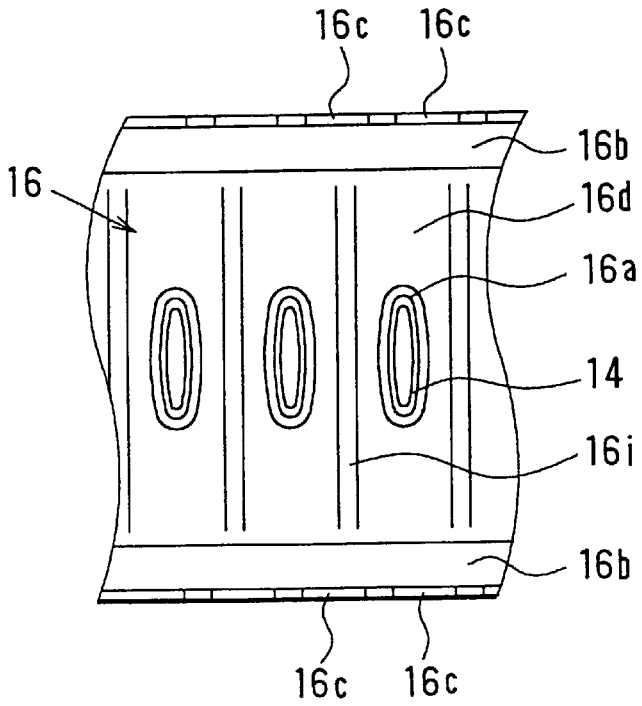
FIG. 10A is an enlarged plan view of a principal part according to the seventh embodiment of the present invention.
Figure 10B:
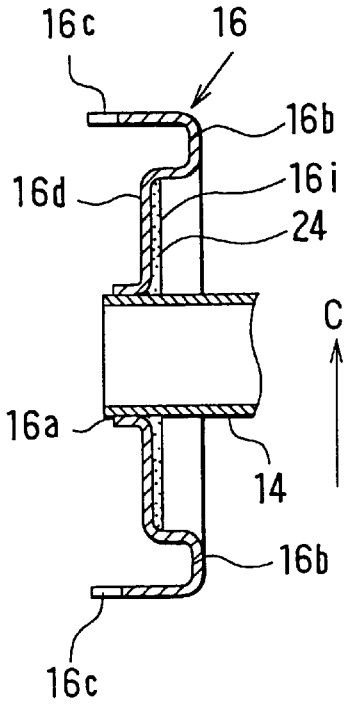
FIG. 10B and FIG. 10*c* are cross sectional views of shown FIG. 10A.
Figure 10C:
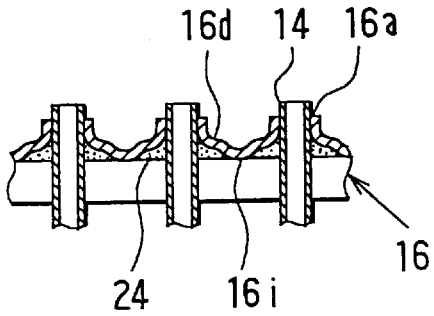

In the seventh embodiment shown in FIGS. 10A–10C, the oval barring hole 16*a* is protruded toward inside the tank (water side) from the main flat portion 16*d* of the core plate 16, and a rib 16*i* being parallel to the main axis direction (upper and lower direction in FIG. 10A) of the oval shaped barring hole 16*a* is formed in the center region between the adjacent barring holes 16*a*. This rib 16*i* is protruded toward the air flowing side (an opposite direction to the protruding direction of the barring hole 16*a*) from the main flat portion 16*d*, and formed covering all width area in the main axis direction (upper and lower direction in FIG. 10A) of the barring hole of the main flat portion 16*d*.

According to the seventh embodiment, by forming this rib 16*i*, increasing the section modulus of the core plate 16 and the rigidity of the core plate 16 is provided.

(Eighth Embodiment)

Figure 11A:
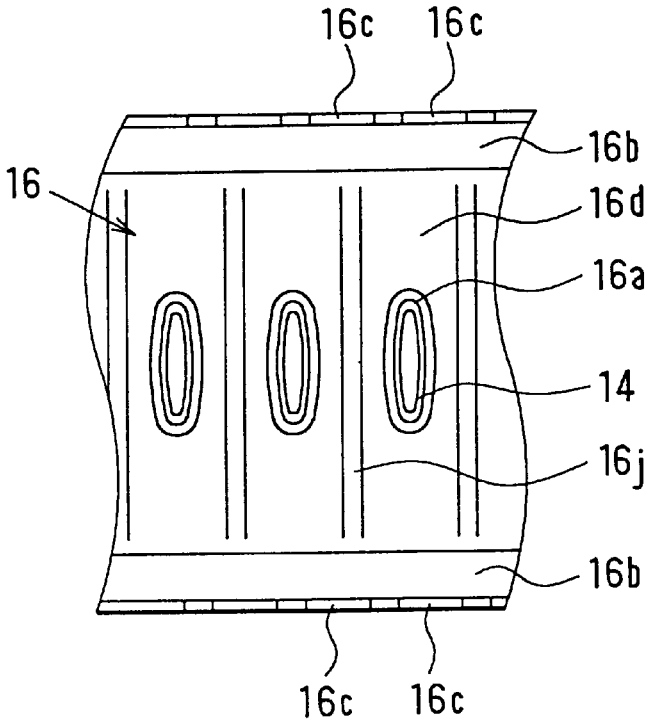
FIG. 11A is an enlarged plan view of a principal part according to the eighth embodiment of the present invention, and FIG. 11B and FIG, 11C are cross sectional views of shown FIG. 11A.
Figure 11B:
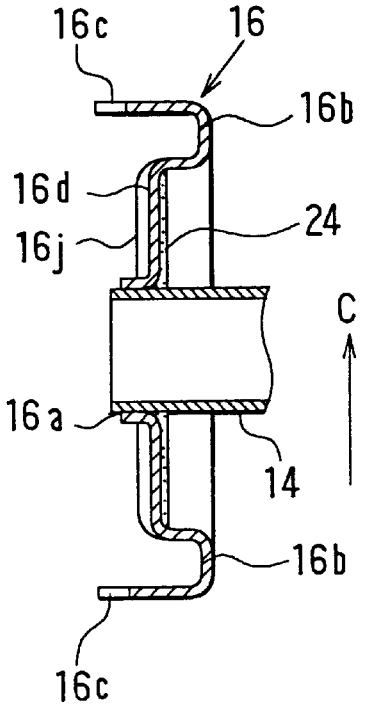
Figure 11C:
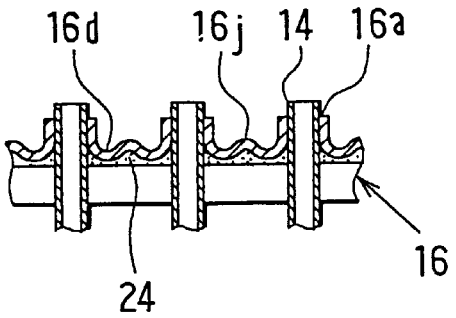

In the eighth embodiment shown in FIGS. 11A–11C, a rib 16*j* corresponding to the rib 16*i* in the seventh embodiment is formed to be protruded toward the protruding direction of the barring hole 16*a* (water side) from the main flat portion 16*d* of the core plate 16.

(Ninth Embodiment)

Figure 12A:
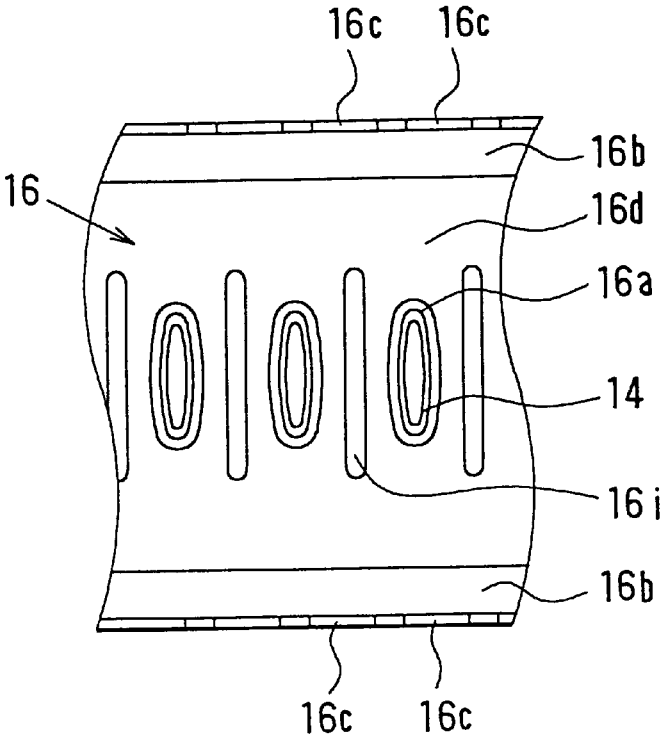
FIG. 12A is an enlarged plan view of a principal part according to the ninth embodiment of the present invention.
Figure 12B:
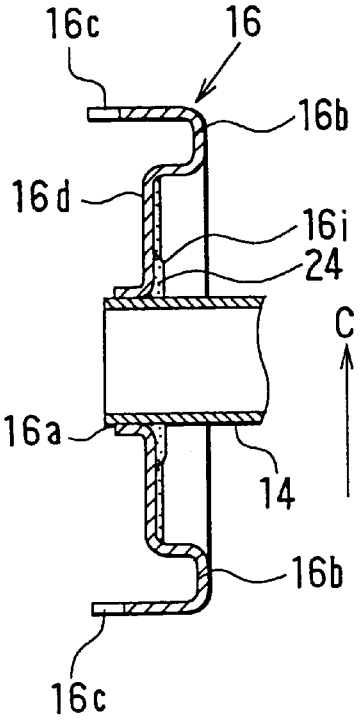
FIG. 12B and FIG. 12C are cross sectional views of shown FIG. 12A.
Figure 12C:
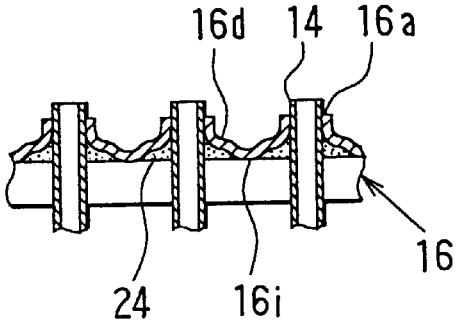

In the seventh embodiment in FIGS. 10A–10C, the rib 16*i* is formed covering the all width area in the main axis direction of the barring hole (upper and lower direction in FIG. 10A) of the main flat portion 16*d*. Contrary to this, in the ninth embodiment shown in FIGS. 12A–12C, this rib 16*i* is set to be shorter than all width dimension of the main flat portion 16*d* in the main axis direction of the barring hole (upper and lower direction in FIG. 10A), and set to be a little longer than the dimension of the barring hole 16*a* in the main axis direction.

(Tenth Embodiment)

Figure 13A:
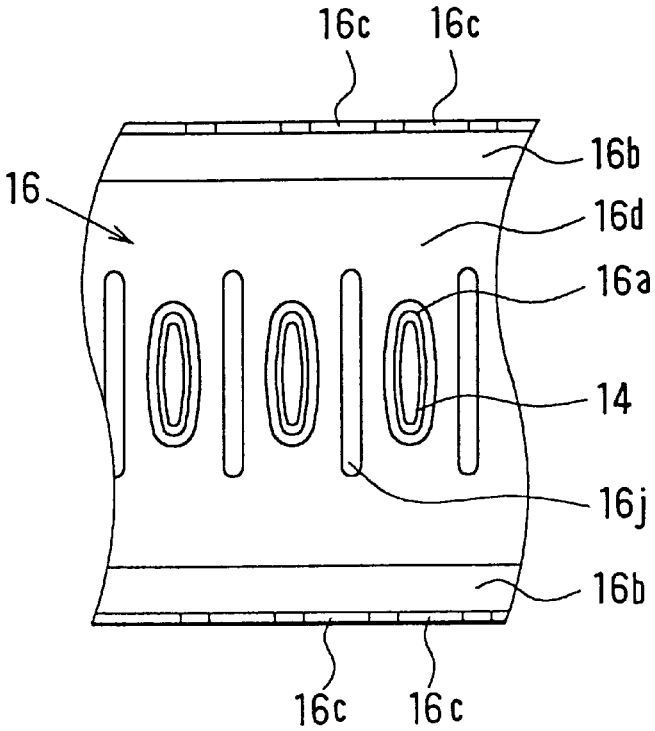
FIG. 13A is an enlarged plan view of a principal part according to the tenth embodiment of the present invention.
Figure 13B:
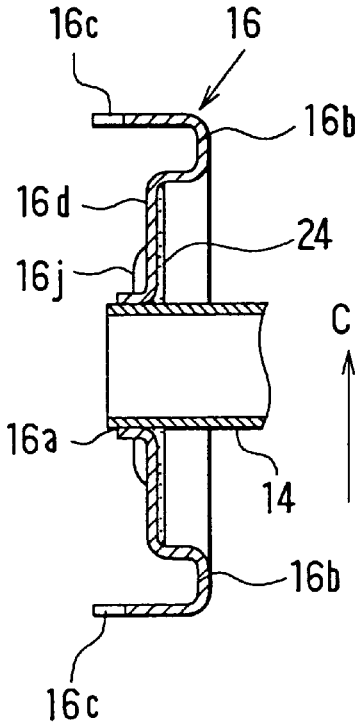
FIG. 13B and FIG. 13C are cross sectional views of shown FIG. 13A.
Figure 13C:
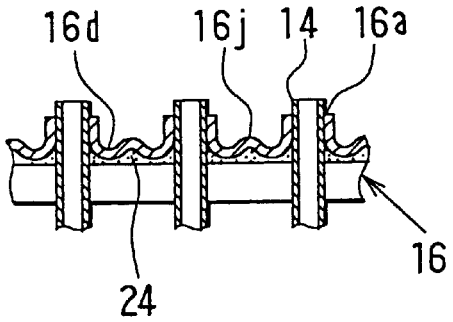

In the tenth embodiment shown in FIGS. 13A–13C, the rib 16*j* in the eighth embodiment in FIGS. 11A–11C is set to be a little longer than the dimension of the barring hole 16*a* in the main axis direction.

(Eleventh Embodiment)

Figure 14A:
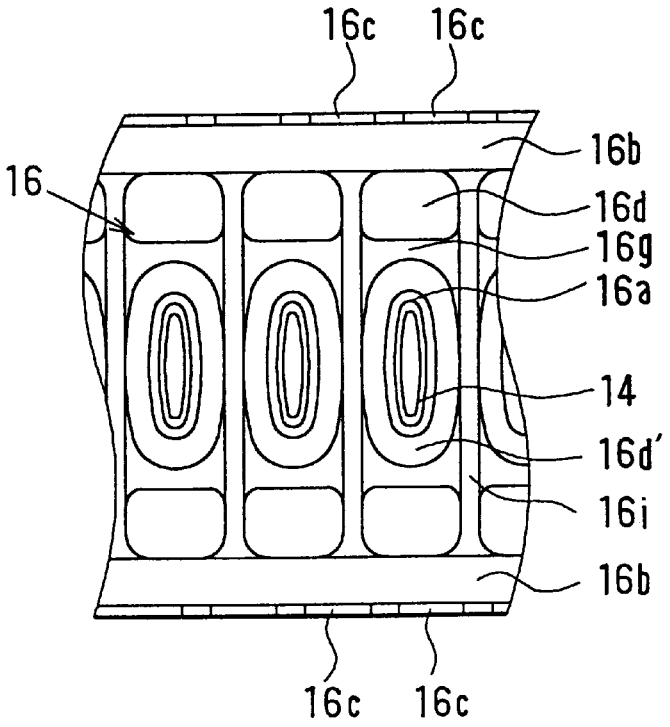
FIG. 14A is an enlarged plan view of a principal part according to the eleventh embodiment of the present invention.
Figure 14B:
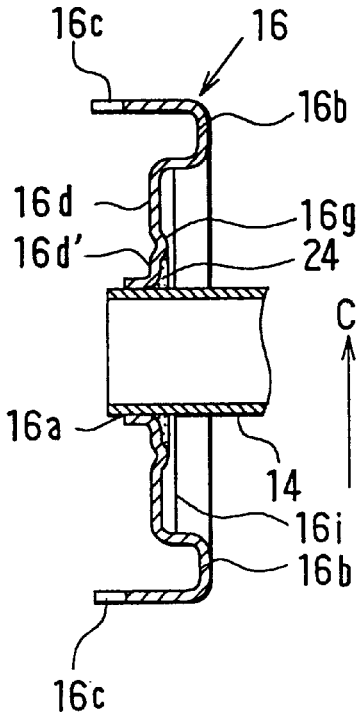
FIG. 14B and FIG. 14C are cross sectional views of shown FIG. 14A.
Figure 14C:
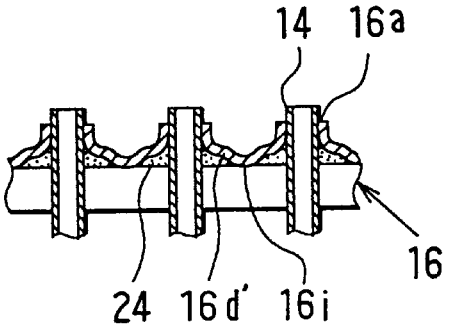

In the eleventh embodiment shown in FIGS. 14A–14C, the same rib 16*j* as described in the seventh embodiment is formed and the combined portion 16*d* of the barring hole 16*a* is located on the same plane as the main flat portion 16*d* (refer to FIG. 14B). Furthermore, between this combined portion 16*d*' and the main flat portion 16*d*, a rib 16*g* (a same rib as the rib 16*g* in FIGS. 6A–6C) protruding toward the air flowing side of these parts 16*d*', 16*d* is formed.

According to the eleventh embodiment, in comparison with the seventh embodiment in FIGS. 10A–10C, it is an advantage that an area for storing the adhesive can be made by forming the rib 16*g*. Furthermore, a rigidity of the core plate 16 in the groove 16*b* side region can be increased due to an irregularity shape of the rib 16*g* and the main flat portion 16*d*. Whereby, increasing the caulking strength of the clip 16*c* of the core plate 16 can be attained.

(Twelfth Embodiment)

Figure 15A:
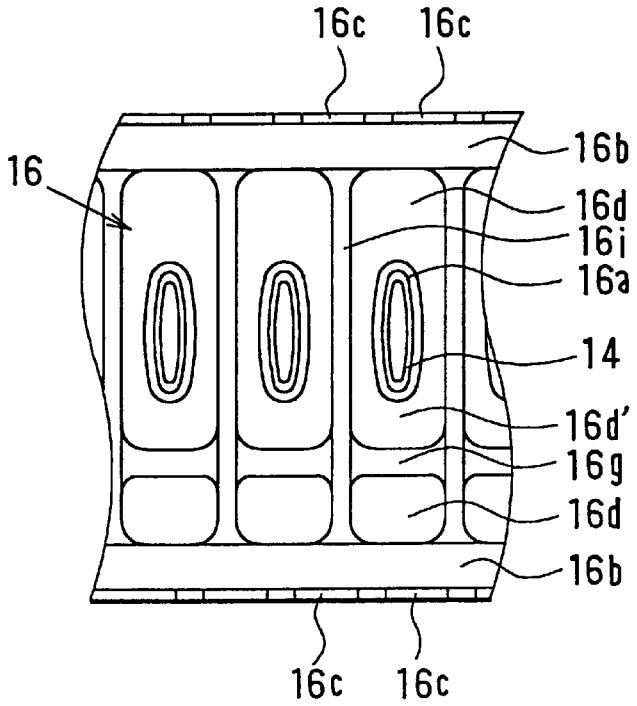
FIG. 15A is an enlarged plan view of a principal part according to the twelfth embodiment of the present invention.
Figure 15B:
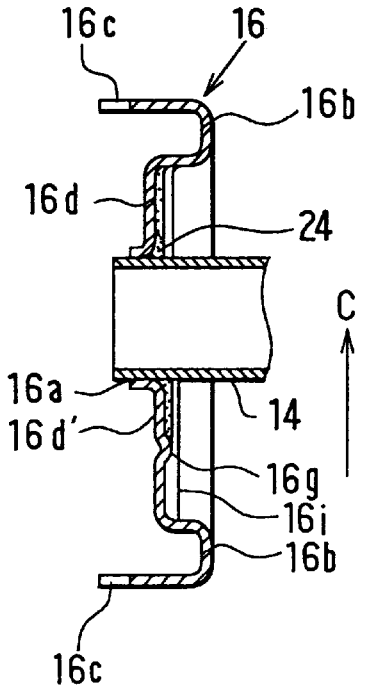
FIG. 15B and FIG. 15C are cross sectional views of shown FIG. 15A.
Figure 15C:
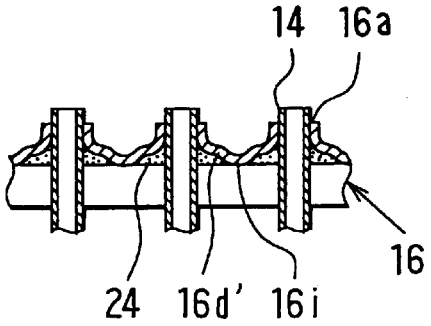
Figure 16A:
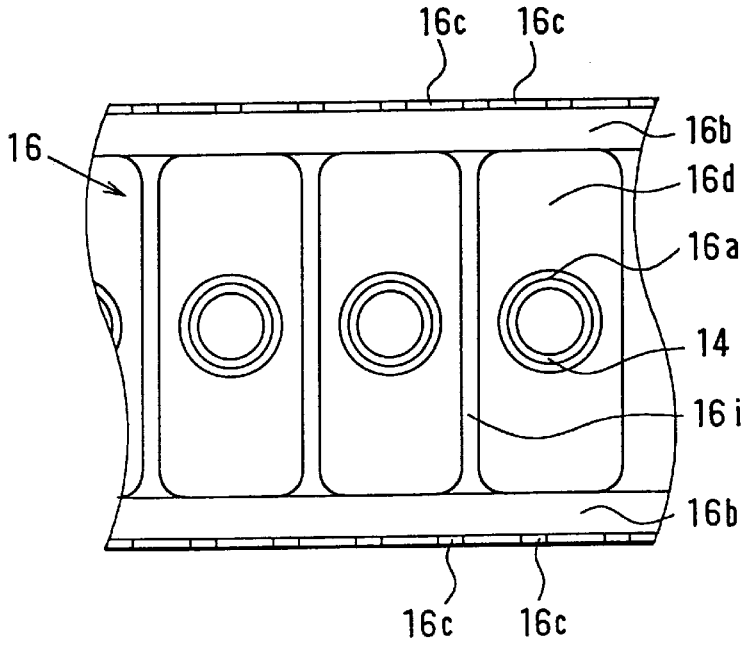
FIG. 16A is an enlarged plan view of a principal part according to the thirteenth embodiment of the present invention.
Figure 16B:
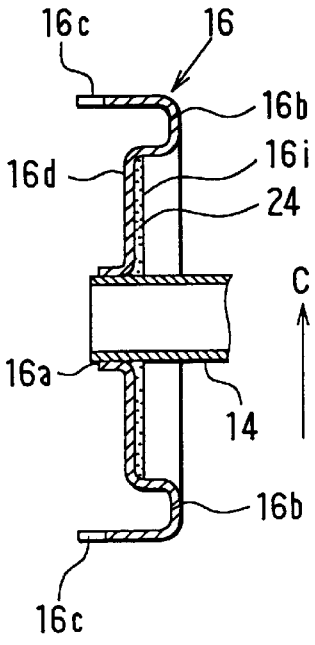
FIG. 16B and FIG. 16C are cross sectional views of shown FIG. 16A.
Figure 16C:
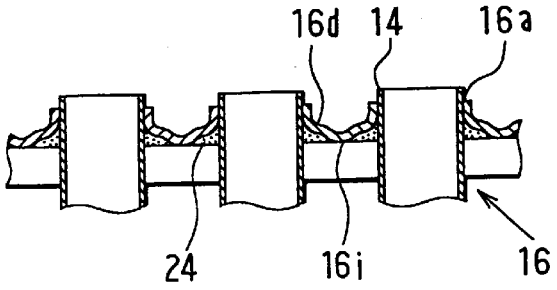
Figure 17A:
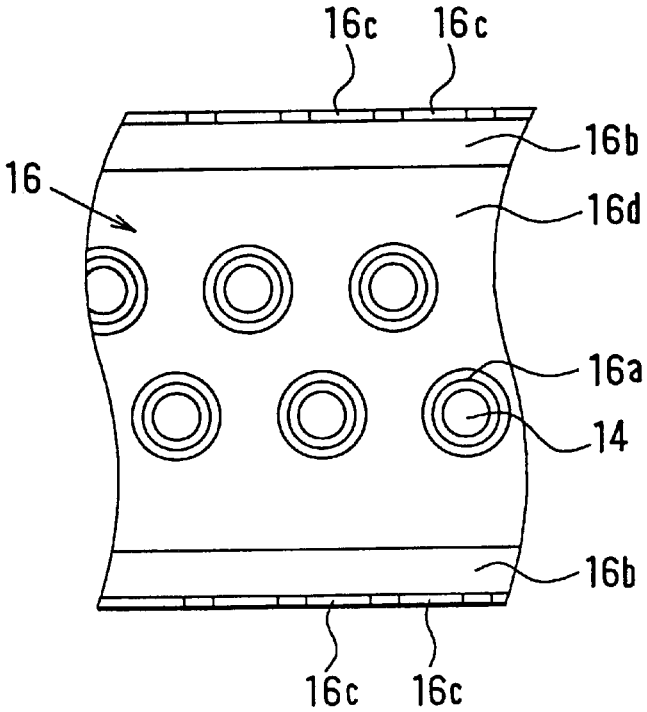
FIG. 17A PRIOR ART
FIG. 17A is an enlarged plan view of a principal part according to the related art.
Figure 17B:
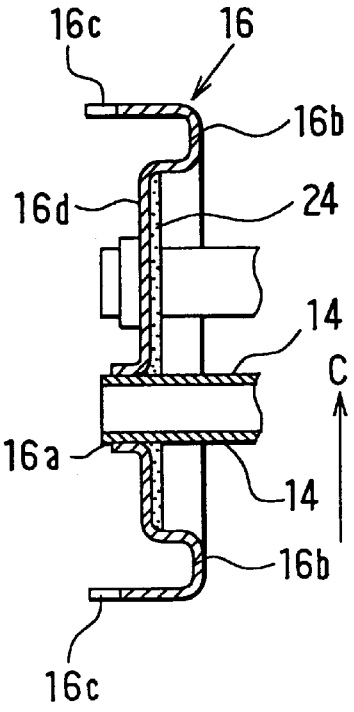
FIG. 17B PRIOR ART
FIG. 17B and FIG. 17C are cross sectional views of shown FIG. 17A.
Figure 17C:
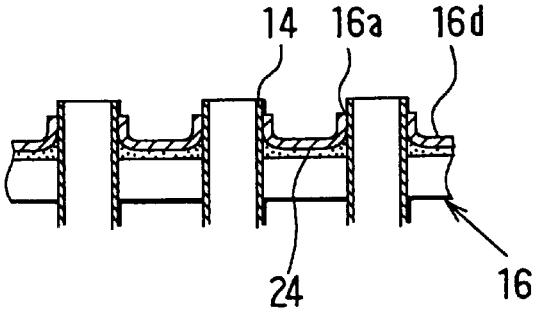
FIG. 17C PRIOR ART
Figure 18A:
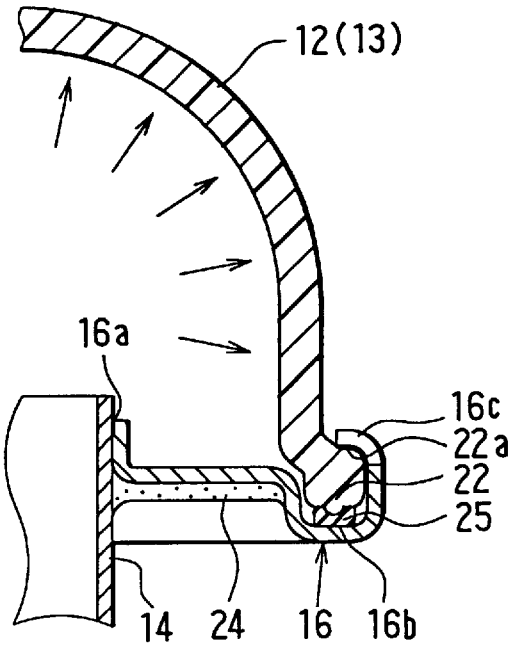
FIG. 18A RELATED ART
FIG. 18A is a cross sectional view of a principal part of a conventional radiator.
Figure 18B:
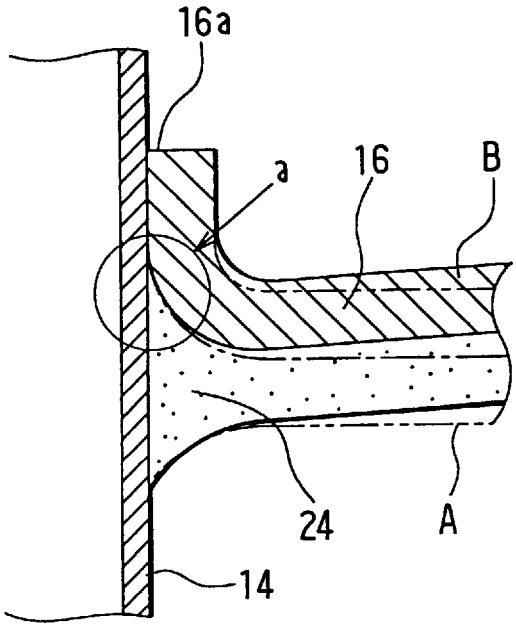
FIG. 18B RELATED ART

According to the eleventh embodiment in FIGS. 14A–14C, the ribs 16*g* are formed at both sides of the tube 14 in the main axis direction. Contrary to this, according to the present twelfth embodiment shown in FIGS. 15A–15C, the rib 16*g* at one side (an above side in the figure) is to be abolished, and at the other side of the oval tube 14 in its main axis direction, the combined portion 16*d*' of the barring hole 16*a* and the main flat portion 16*d* are formed on the same plane in a continuous manner.

(Thirteenth Embodiment)

According to the present thirteenth embodiment, the oval tube 14 in the seventh embodiment in FIGS. 10A–10C is replaced with a cylindrical tube 14.

(Modified Example)

According to the above-described embodiments, the barring hole 16*a* of the core plate 16 is protruded toward inside the tank (water flowing side). Contrary to this, protruding the barring hole 16*a* toward outside the tank (air flowing side) from the main flat portion 16*d* is possible. In this case, applying several core plate reinforcing structure disclosed in the first to tenth embodiment to both water flowing side and air flowing side of the main flat portion 16*d* can be done.

Further, in the above-modified example, the cup shaped portion of the barring hole 16*a* is formed inside the tank (water flowing side), so it is preferable that the adhesive is potted on the inside of the tank (water flowing side) surface of the core plate 16 for simplifying a coating operation.

Also, in the above embodiments, the case of arranging the tube 14 in only one row with respect to the cooling air flowing direction was explained. In addition to this, it is for granted that applying the present invention to such case that the tube 14 is arranged in two or more rows with respect to the cooling air flowing direction C is possible.

Furthermore, in the above embodiments, one example that the present invention is applied to the car engine cooling radiator is explained. In addition to this, it is for granted that the present invention can be applied to the other heat exchanger such as a heater core.

What is claimed that:

1. A mechanically assembled type heat exchanger comprising:

a tank provided with at least an inlet port into which a fluid to be heat exchanged flows, or an outlet port from which the heat exchanged fluid flows out;

a core plate connected to an opening surface of said tank;

a sealing packing disposed between said core plate and said tank;

said core plate having a hole thereon;

a tube, an end portion of which is inserted into said hole, and press fit to said core plate;

a resin adhesive potted on said core plate and sealing the press fit portion of the end portion of said tube; and a reinforcing member arranged at least around said hole for increasing a rigidity of said core plate; wherein said core plate has a main flat portion;

a combined portion us formed on the substantially same plane as said main flat portion outside hole, and a first rib is protruded from a plane of said main flat portion as said reinforcing member between said combined portion and said main flat portion.

2. A mechanically assembled type heat exchanger according to claim 1, wherein said tank is an upper tank provided with said inlet port, and a lower tank provided with said outlet port.

3. A mechanically assembled type heat exchanger according to claim 1, wherein said hole is provided at a plurality of locations of said core plate, and a second rib is protruded from the plane of said main flat portion as said reinforcing member at a center region between said adjacent holes.

4. A mechanically assembled type heat exchanger according to claim 3, wherein said first rib and said second rib intersect with each other orthogonally.

5. A mechanically assembled type heat exchanger according to claim 1, wherein, said core plate has a main flat portion, and said hole is provided with a protrusion portion protruded from a plane of the main flat portion of said core plate.

6. A mechanically assembled type heat exchanger according to claim 1, wherein said tube is formed into a cross sectional oval shape;

said oval tube is arranged in such a manner that a main axis direction of said oval tube is parallel to a flowing direction of a heat exchanged media flowing outside said tube, and said hole is in a oval shape corresponding to said oval tube.

7. A mechanically assembled type heat exchanger according to claim 6, wherein a plate fin is press fit to said oval tube integrally.

8. A mechanically assembled type heat exchanger comprising:

a tank provided with at least an inlet port into which a fluid to be heat exchanged flows, or an outlet port from which the heat exchanged fluid flows out;

a core plate connected to an opening surface of said tank;

a sealing packing disposed between said core plate and said tank;

said core plate having a hole thereon;

a tube, an end portion of which is inserted into said hole, and press fit to said core plate;

an adhesive potted on said core plate and sealing the press fit portion of the end portion of said tube; and a reinforcing member arranged at least around said hole for increasing a rigidity of said core plate; wherein said core plate has a main portion;

a combined portion is formed on the substantially same plane as said main flat portion outside said hole; and a rib is protruded from a plane of said main flat portion as said reinforcing member between said combined portion and said main flat portion.

9. A mechanically assembled type heat exchanger comprising:

a tank provided with at least an inlet port into which a fluid to be heat exchanged flows, or an outlet port from which the heat exchanged fluid flows out;

a core plate connected to an opening surface of said tank;

a sealing packing disposed between said core plate and said tank;

said core plate having a hole thereon;

a tube, an end portion of which is inserted into said hole, and press fit to said core plate;

an adhesive potted on said core plate and sealing the press fit portion of the end portion of said tube; and a reinforcing member arranged at least around said hole for increasing a rigidity of said core plate; wherein said core plate has a main portion;

a combined portion is formed on the substantially same plane as said main flat portion outside said hole;

a first rib is protruded from a plane of said main flat portion as said reinforcing member between said combined portion and said main flat portion;

said hole is provided at a plurality of locations of said core plate; and a second rib is protruded from the plane of said main flat portion as said reinforcing member at a center region between said adjacent holes.

10. A mechanically assembled type heat exchanger comprising:

a tank provided with at least an inlet port into which a fluid to be heat exchanged flows, or an outlet port from which the heat exchanged fluid flows out;

a core plate connected to an opening surface of said tank;

a sealing packing disposed between said core plate and said tank;

said core plate having a hole thereon;

a tube, an end portion of which is inserted into said hole, and press fit to said core plate;

an adhesive potted on said core plate and sealing the press fit portion of the end portion of said tube; and a reinforcing member arranged at least around said hole for increasing a rigidity of said core plate; wherein said core plate has a main portion;

a combined portion is formed on the substantially same plane as said main flat portion outside said hole;

a first rib is protruded from a plane of said main flat portion as said reinforcing member between said combined portion and said main flat portion;

said hole is provided at a plurality of locations of said core plate;

a second rib is protruded from the plane of said main flat portion as said reinforcing member at a center region between said adjacent holes; and said first rib and said second rib intersect with each other orthogonally.

* * * * *